US007222930B2

(12) United States Patent
Niimi

(10) Patent No.: US 7,222,930 B2
(45) Date of Patent: May 29, 2007

(54) INKJET RECORDING SYSTEM

(75) Inventor: Akiko Niimi, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/032,140

(22) Filed: Jan. 11, 2005

(65) Prior Publication Data

US 2005/0151792 A1 Jul. 14, 2005

(30) Foreign Application Priority Data

Jan. 14, 2004 (JP) ..... 2004-007329

(51) Int. Cl.
*B41J 2/205* (2006.01)

(52) U.S. Cl. ..... 347/15; 347/41

(58) Field of Classification Search ..... 347/15, 347/41, 43, 16

See application file for complete search history.

(56) References Cited

U.S. PATENT DOCUMENTS

2004/0174403 A1* 9/2004 Yoshida et al. ..... 347/15

FOREIGN PATENT DOCUMENTS

| | | |
|---|---|---|
| JP | A 6-24009 | 2/1994 |
| JP | A 9-58022 | 3/1997 |
| JP | A 9-296380 | 11/1997 |

* cited by examiner

*Primary Examiner*—Lamson Nguyen
(74) *Attorney, Agent, or Firm*—Oliff & Berridge, PLC

(57) ABSTRACT

An inkjet recording device is provided with a first ejecting system that operates to eject at least one ink whose color has a maximum L* value among the plurality of inks onto one or a predetermined number of lines on the substrate at a time, a second ejecting system that operates to eject at least an ink whose color has a minimum L* value among the plurality of inks, the second ejecting system ejecting inks which are not ejected by the first ejecting system onto the same lines, onto which the first ejecting system has ejected the at least one ink whose color has the maximum L* value, at a time, and a controlling system that controls the first ejecting system and the second ejecting system such that the first ejecting system operates a predetermined period after the first ejecting system has operated.

18 Claims, 11 Drawing Sheets

FIG.10

300

| SCANTIER PREVENTION MODE FLAG | PIXEL | C | M | Y | K | PIXEL | C | M | Y | K | PIXEL | C | M | Y | K | PIXEL | C | M | Y | K | PIXEL | C | M | Y | K | PIXEL | C | M | Y | K |
|---|---|---|---|---|---|---|---|---|---|---|---|---|---|---|---|---|---|---|---|---|---|---|---|---|---|---|---|---|---|---|
| 1 | 1.1 | 5 | 22 | 15 | 0 | 1.2 | 0 | 0 | 100 | 0 | 1.3 | 0 | 0 | 100 | 0 | 1.4 | 0 | 0 | 100 | 0 | 1.5 | 0 | 0 | 100 | 0 | 1.6 | 9 | 0 | 90 | 0 |

ONLY C. M AND Y COMPONENTS

| PIXEL | C | M | Y | K | PIXEL | C | M | Y | K | PIXEL | C | M | Y | K | PIXEL | C | M | Y | K | PIXEL | C | M | Y | K | PIXEL | C | M | Y | K | PIXEL | C | M | Y | K |
|---|---|---|---|---|---|---|---|---|---|---|---|---|---|---|---|---|---|---|---|---|---|---|---|---|---|---|---|---|---|---|---|---|---|
| 300.450 | 10 | 7 | 90 | 0 | 1.1 | 0 | 0 | 0 | 85 | 1.2 | 0 | 0 | 0 | 1 | 1.3 | 0 | 0 | 0 | 1 | 1.4 | 0 | 0 | 0 | 1 | 1.5 | 0 | 0 | 0 | 1 | 1.6 | 0 | 0 | 0 | 100 |

ONLY K COMPONENT

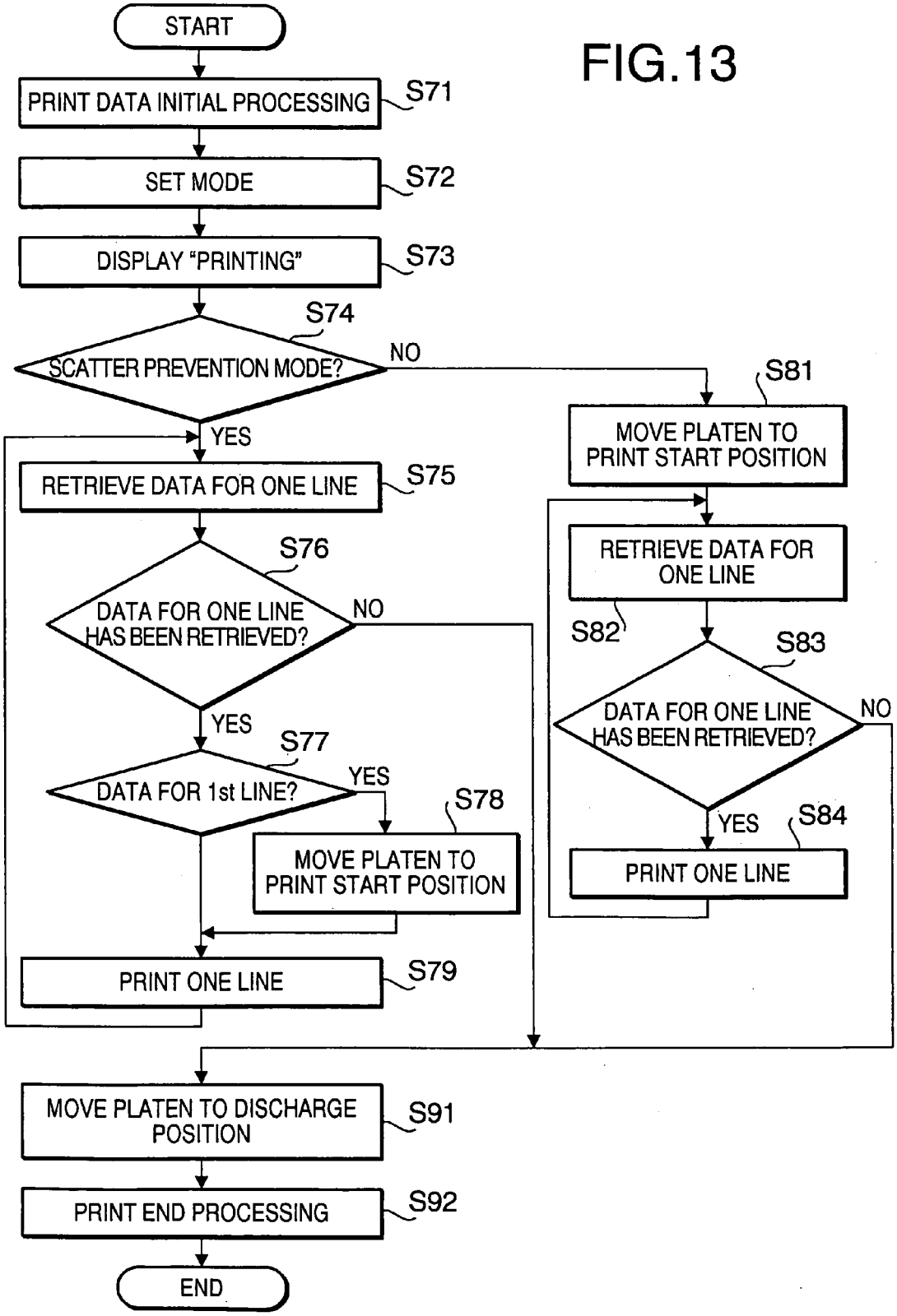
FIG.13
START
PRINT DATA INITIAL PROCESSING
S71
SET MODE
S72
DISPLAY "PRINTING"
S73
S74
SCATTER PREVENTION MODE?
NO
YES
RETRIEVE DATA FOR ONE LINE
S75
S76
DATA FOR ONE LINE HAS BEEN RETRIEVED?
NO
YES
S77
DATA FOR 1st LINE?
YES
S78
MOVE PLATEN TO PRINT START POSITION
PRINT ONE LINE
S79
S81
MOVE PLATEN TO PRINT START POSITION
RETRIEVE DATA FOR ONE LINE
S82
S83
DATA FOR ONE LINE HAS BEEN RETRIEVED?
NO
YES
S84
PRINT ONE LINE
MOVE PLATEN TO DISCHARGE POSITION
S91
PRINT END PROCESSING
S92
END

INKJET RECORDING SYSTEM

INCORPORATION BY REFERENCE

This application claims priority from Japanese Patent Application No. 2004-007329 filed on Jan. 14, 2004, the entire subject matter of the applications is incorporated herein by reference thereto.

BACKGROUND OF THE INVENTION

The present invention relates to an inkjet recording system, and more particularly to an inkjet recording system in which scatter of ink at an image formation by an inkjet recording device is prevented.

The inkjet recording device is generally configured such that ink is introduced from an ink supplier to ink ejection channels of an inkjet head, and by selectively driving actuators such as heat generating elements or piezoelectric elements, ink is ejected from ejection nozzles provided at tips of the ejection channels. When a color image is formed, the image is divided into primary color components, for example, Cyan (C), Magenta (M) and Yellow (Y) components, and each color image is formed to overlap. By adjusting the thickness of the color components, a desired color is created. When a black image is formed, or when the color image includes a black component, black (K) ink is also used.

The ink ejected from the ejection nozzles may scatter when it reached a target medium, on which an image is formed. Then, the scattered ink drops on or between ink drops of other colors and pervades among the ink drops of other colors, which results in a blot of the ink. In this specification, such a condition (i.e., the blot of the ink on the target medium) is also referred to as a scatter. In order to prevent the scatter, various method has been suggested. For example, Japanese Patent Provisional Publication No. HEI 09-58022 discloses a method for suppressing the scatter of the ink drops by controlling the speed of the ejected ink drops. Another example is disclosed in Japanese Patent Provisional Publication No. 06-24009. According to the disclosure of this publication, the order of the color components is determined such that a color component image of a higher pixel density is formed prior to color component images having lower pixel densities. Further, Japanese Patent Provisional Publication No. HEI 09-296380 discloses a method of printing, with ink containing a scatter preventing agent, outlines of each image and boundaries at areas having different colors.

According to the method described in the first and second publications above, ejection of the ink should be controlled precisely. According to the third method, it is necessary to prepare the ink containing the scatter preventing agent, which requires a pre-operation work and extra cost therefor.

SUMMARY OF THE INVENTION

The present invention is advantageous in that an inkjet recording device is capable of avoiding the scatter of the ink of the formed image.

According to an aspect of the invention, there is provided an inkjet recording device that ejects a plurality of inks to form an image on a substrate. The inkjet recording device is provided with a first ejecting system that operates to eject at least one ink whose color has a maximum L* value among the plurality of inks onto one or a predetermined number of lines on the substrate at a time, a second ejecting system that operates to eject at least an ink whose color has a minimum L* value among the plurality of inks, the second ejecting system ejecting inks which are not ejected by the first ejecting system onto the same lines, onto which the first ejecting system has ejected the at least one ink whose color has the maximum L* value, at a time, and a controlling system that controls the first ejecting system and the second ejecting system such that the first ejecting system operates a predetermined period after the first ejecting system has operated.

According to another aspect of the invention, there is provided an inkjet recording device that ejects a plurality of inks to form an image on a substrate, which is provided with a first ejecting system that operates to eject all of the plurality of inks except at least an ink whose color has a minimum L* value among the plurality of inks onto one or a predetermined number of lines on the substrate at a time;, a second ejecting system that operates to eject remaining inks which are not ejected by the first ejecting system onto the same lines, onto which the first ejecting system has ejected the inks, at a time, and a controlling system that controls the first ejecting system and the second ejecting system such that the second ejecting system operates a predetermined period after the first ejecting system has operated.

Optionally, the first ejecting system may be configured to eject all of the inks whose colors have L* values greater than 40 among the plurality of inks, and wherein the second ejecting system may be configured to eject all of the inks whose colors have L* values equal to or less than 40 among the plurality of inks.

In a particular case, the inks whose colors have L* values equal to or less than 40 include a black ink.

Optionally, the first ejecting system may be configured to eject all of the inks whose colors have L* values equal to or greater than 60 among the plurality of inks, and the second ejecting system may be configured to eject all of the inks whose colors have L* values less than 60 among the plurality of inks.

In a particular case, the inks whose colors have L* values equal to or greater than 60 may include a yellow ink.

Further optionally, the first ejecting system may be configured to eject only the ink whose color has the maximum L* value among the plurality of inks, and the second ejecting system may be configured to eject all of the inks other than the ink whose color has the maximum L* value among the plurality of color inks.

According to a furthermore aspect of the invention, there is provided an inkjet recording device that ejects a plurality of color inks to form an image on a substrate, which is provided with a first controlling system that controls the inkjet recording device to operate in a first recording mode in which at least an ink whose color has a minimum L* value is ejected after an ink whose color has a maximum L* value to form one or plurality of lines on the substrate, and a second controlling system that controls the inkjet recording device to operate in a second recording mode in which all of the plurality of inks are ejected substantially at the same time to form one or plurality of lines on the substrate.

Optionally, the first ejecting system may be configured to eject all of the inks whose colors have L* values greater than 40 among the plurality of inks, and wherein the second ejecting system may be configured to eject all of the inks whose colors have L* values equal to or less than 40 among the plurality of inks.

In a particular case, the inks whose colors have L* values equal to or less than 40 include a black ink.

Optionally, the first ejecting system may be configured to eject all of the inks whose colors have L* values equal to or greater than 60 among the plurality of inks, and the second ejecting system may be configured to eject all of the inks whose colors have L* values less than 60 among the plurality of inks.

In particular case, the inks whose colors have L* values equal to or greater than 60 may include a yellow ink.

Optionally, the first controlling system may be configured to control the inkjet recording device such that the inks whose colors have the L* values equal to or less than 40 are ejected after the inks whose colors have the L* values greater than 40 in the first recording mode.

In a particular case, the inks whose colors have L* values equal to or less than 40 include a black ink.

Still optionally, the first controlling system may be configured to control the inkjet recording device such that the inks whose colors have the L* values less than 60 are ejected after the inks whose colors have the L* values equal to or greater than 60 in the first recording mode.

In a particular case, the inks whose colors have L* values equal to or greater than 60 include a yellow ink.

Further optionally, the inkjet recording device may be provided with a selecting system that enables an operator of the inkjet recording device to select one of the first recording mode and the second recording mode.

According to another aspect of the invention, there is provided an inkjet recording system, which is provided with an inkjet recording device that ejects a plurality of inks in accordance with print data to form an image on a substrate, and an external device that creates the print data for the inkjet recording device. The inkjet recording device that ejects at least an ink whose color has a minimum L* value predetermined period after ejection of at least an ink whose color has a maximum L* value to form a same line on the substrate.

Optionally, the inkjet recording device may include a plurality of inkjet heads that eject the plurality of inks, respectively, and a controlling system that actuates, in accordance with the print data, all of the plurality of inkjet heads except at least an inkjet head corresponding to the ink whose color has the minimum L* value and then, after a predetermined period, remaining inkjet heads including the inkjet head corresponding to the ink whose color has the minimum L* value to form a same line on the substrate.

Further optionally, the external device may include a print data creating system that creates first data in which at least print data corresponding to an ink having the minimum L* value is removed and second data in which print data corresponding to remaining inks including the ink whose color has the minimum L* value, and the inkjet recording device may operate in accordance with the second data predetermined after the inkjet recording device has operated in accordance with the first data.

According to a further aspect of the invention, there is provided a method of forming an image on a substrate by ejecting a plurality of inks. The method includes a first step of ejecting at least one ink whose color has a maximum L* value among the plurality of inks onto one or a predetermined number of lines on the substrate at a time, and a second step of ejecting remaining inks which have not been ejected by the first step onto the same one or predetermined number of lines a predetermined period later.

Optionally, the first step may eject all the inks whose colors have the L* values greater than 40, and the second step may eject all the inks whose colors have the L* values equal to or less than 40.

Further optionally, the first step may eject all the inks whose colors have the L* values equal to or greater than 60, the second step may eject all the inks whose colors have the L* values less than 60.

Still optionally, the first step may eject all the inks other than an ink whose color has a minimum L* value, and the second step may eject only the ink whose color has the minimum L* values.

BRIEF DESCRIPTION OF THE ACCOMPANYING DRAWINGS

Figure 1:
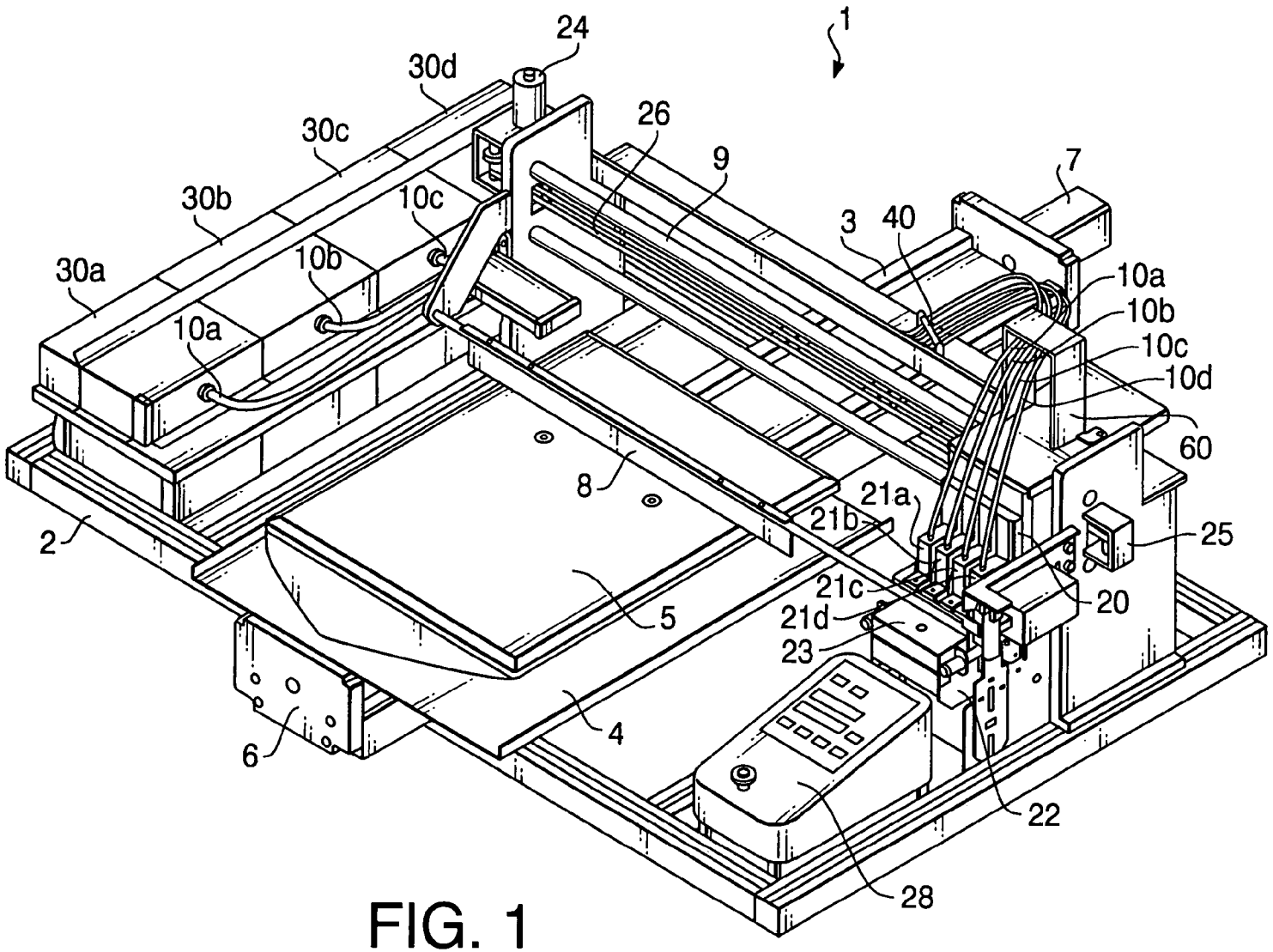
FIG. 1 is a perspective view schematically showing entire configuration of an inkjet recording device to which the present invention is applicable.
Figure 4:
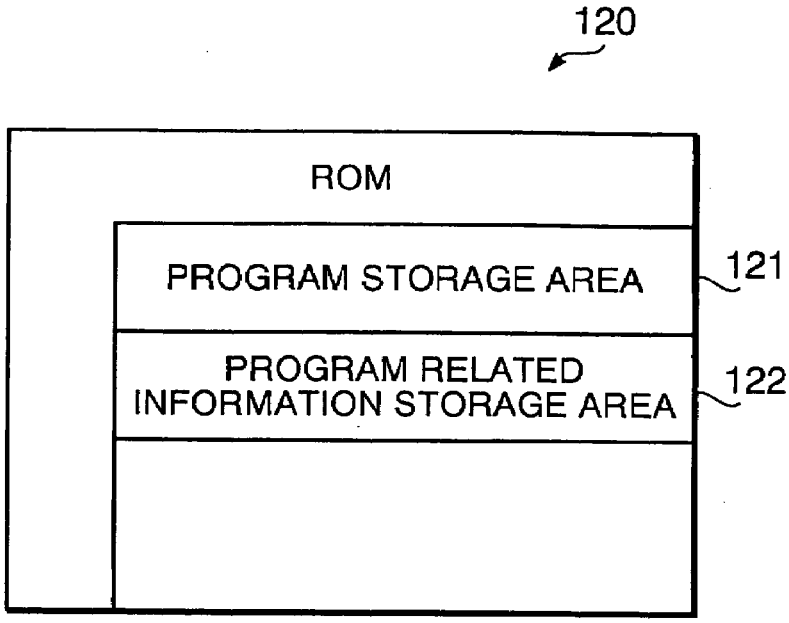
Figure 5:
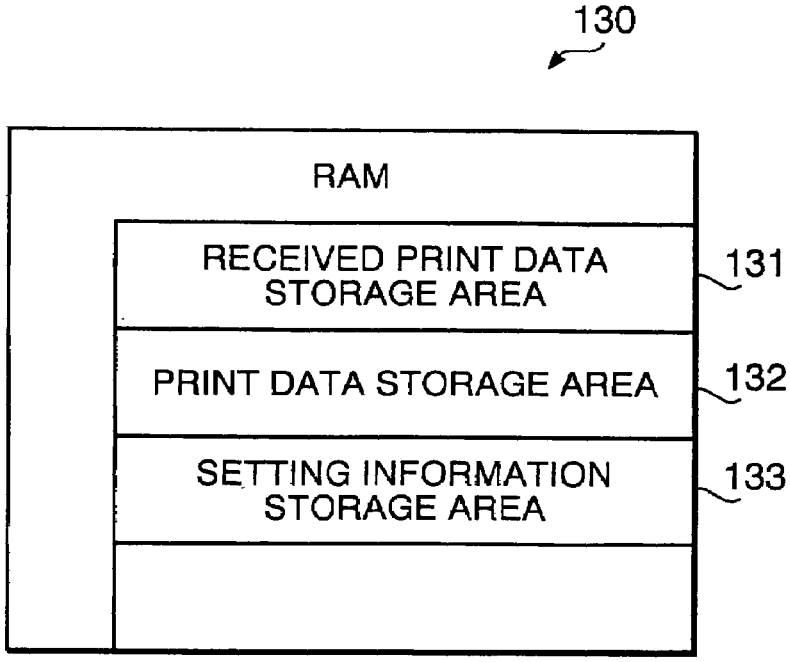
Figure 6:
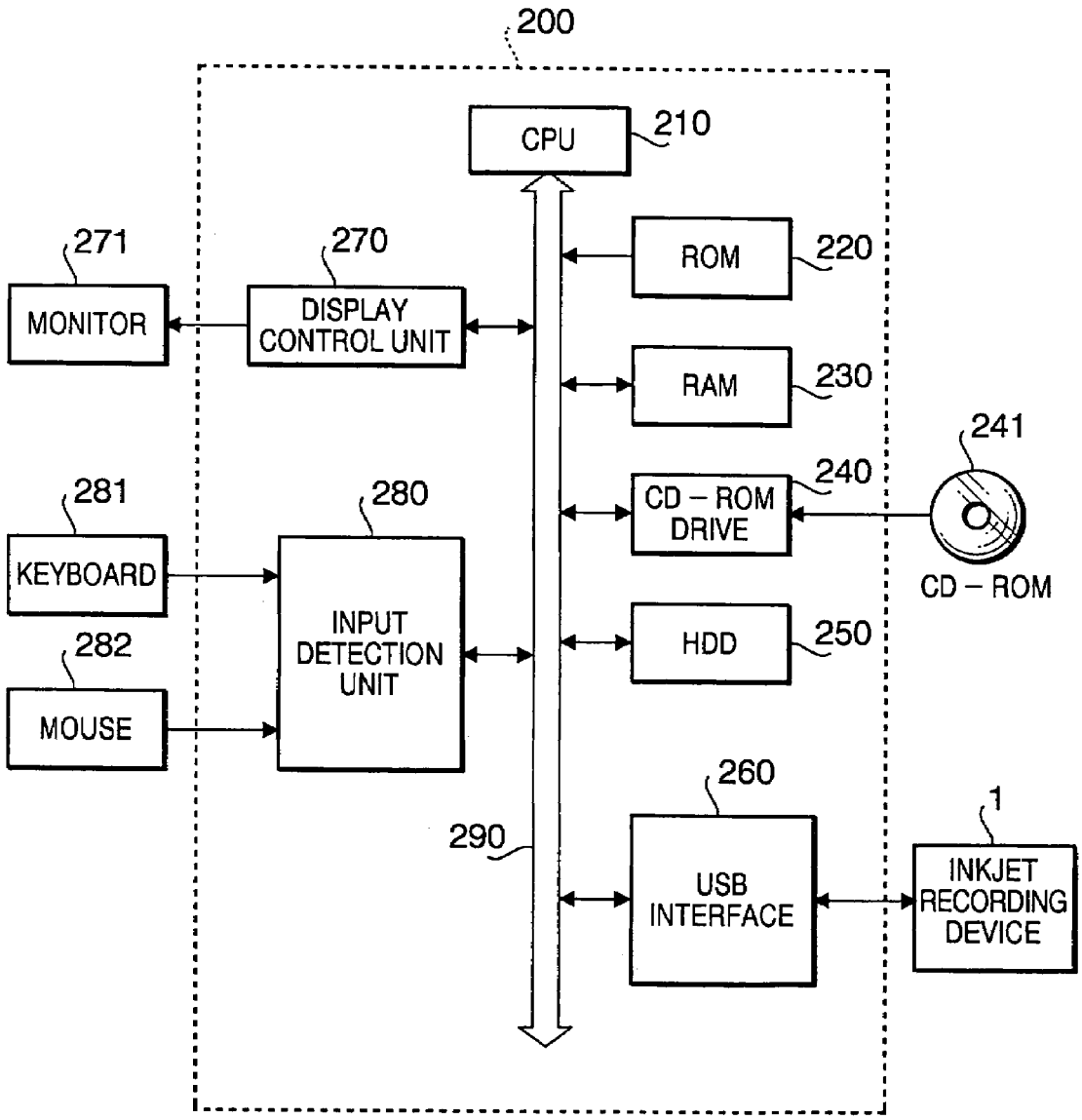
Figure 7:
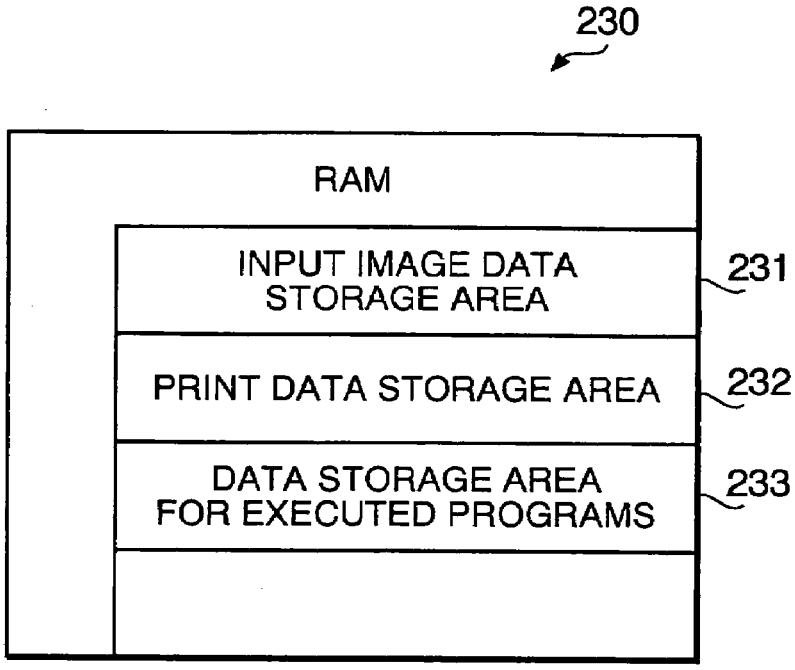
Figure 8:
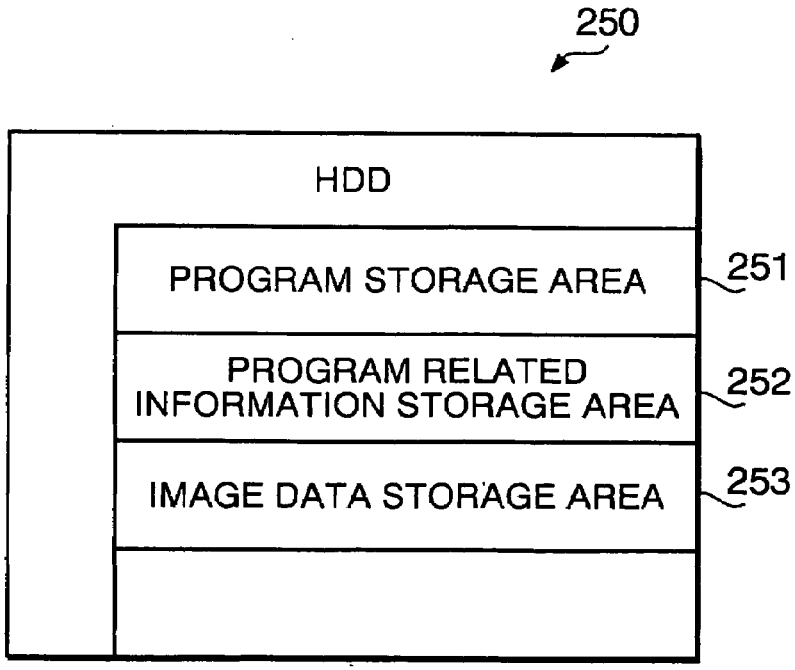
Figure 9:
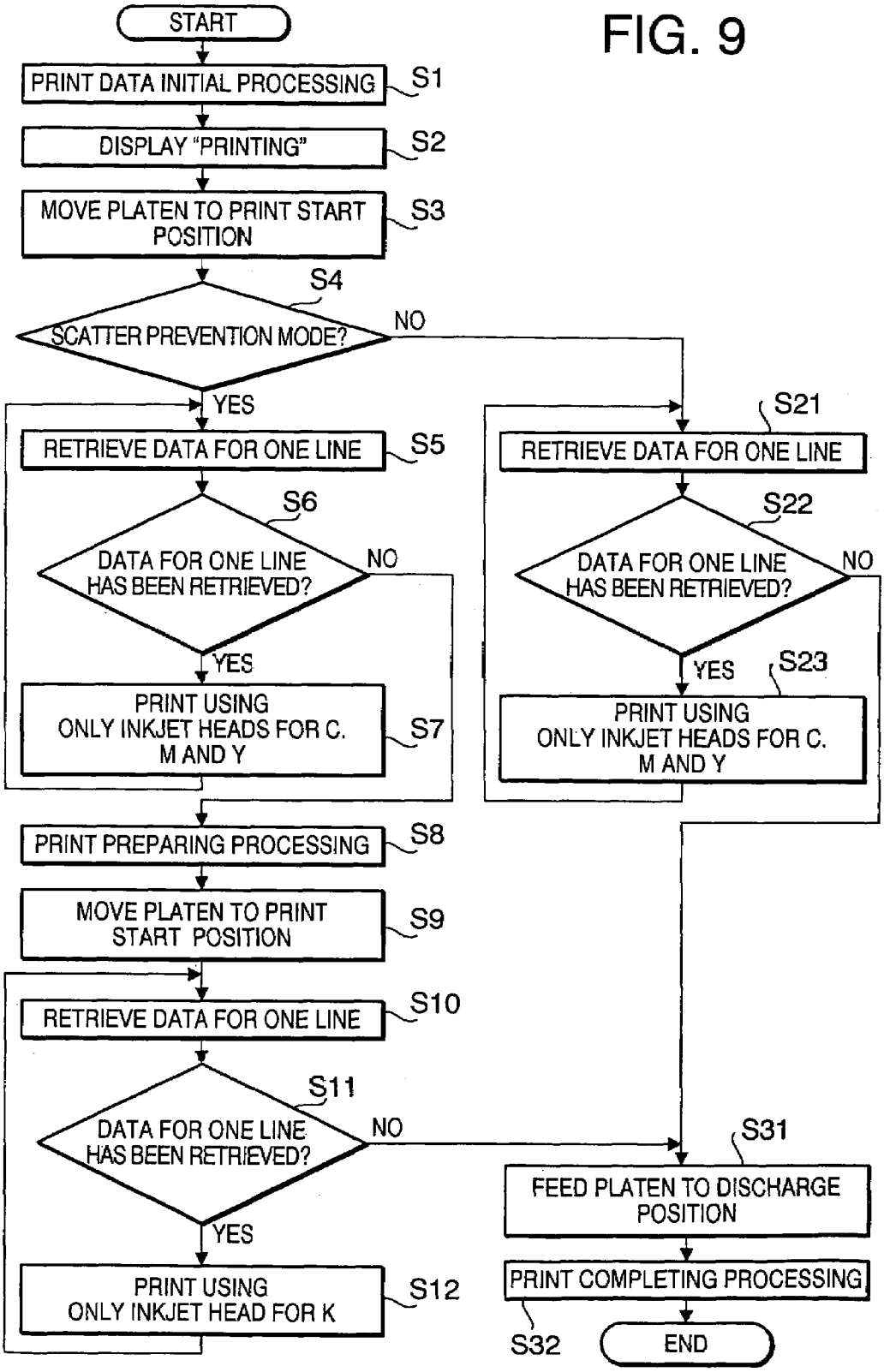
Figure 11:
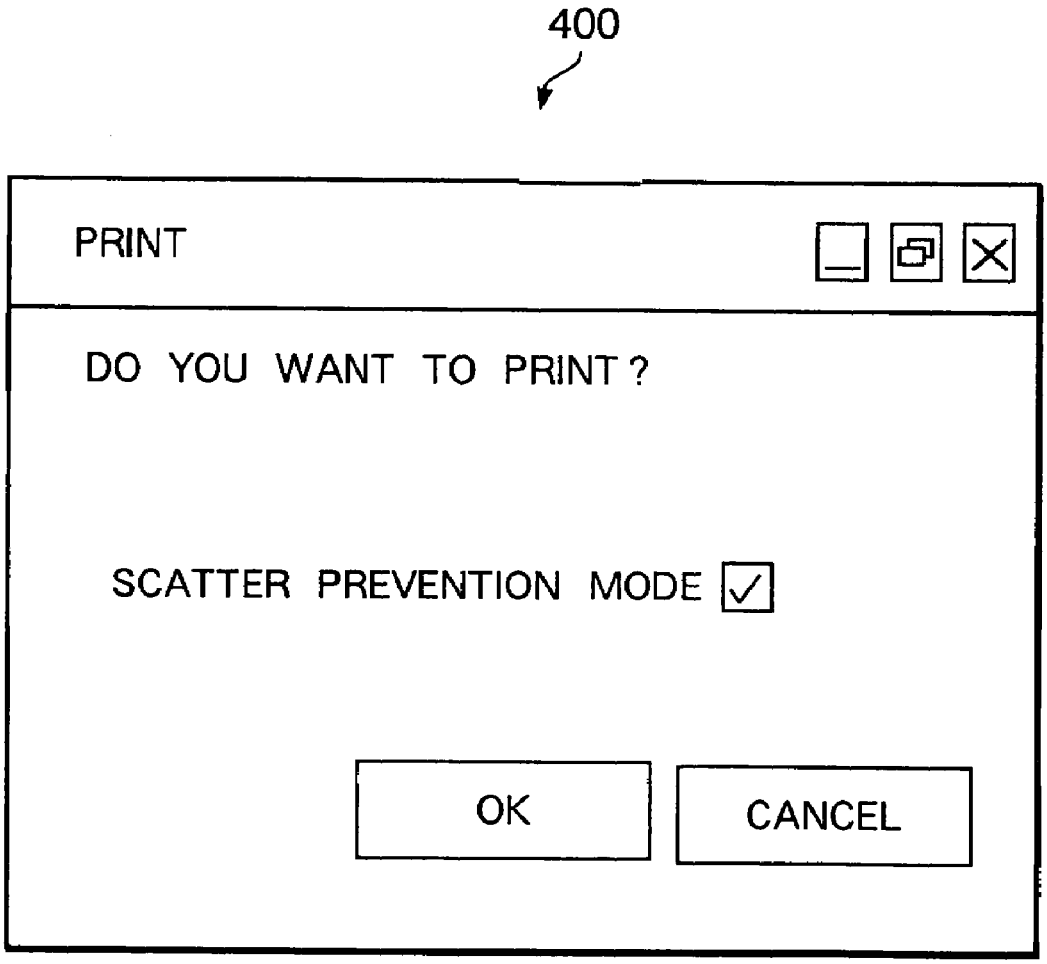
Figure 12:
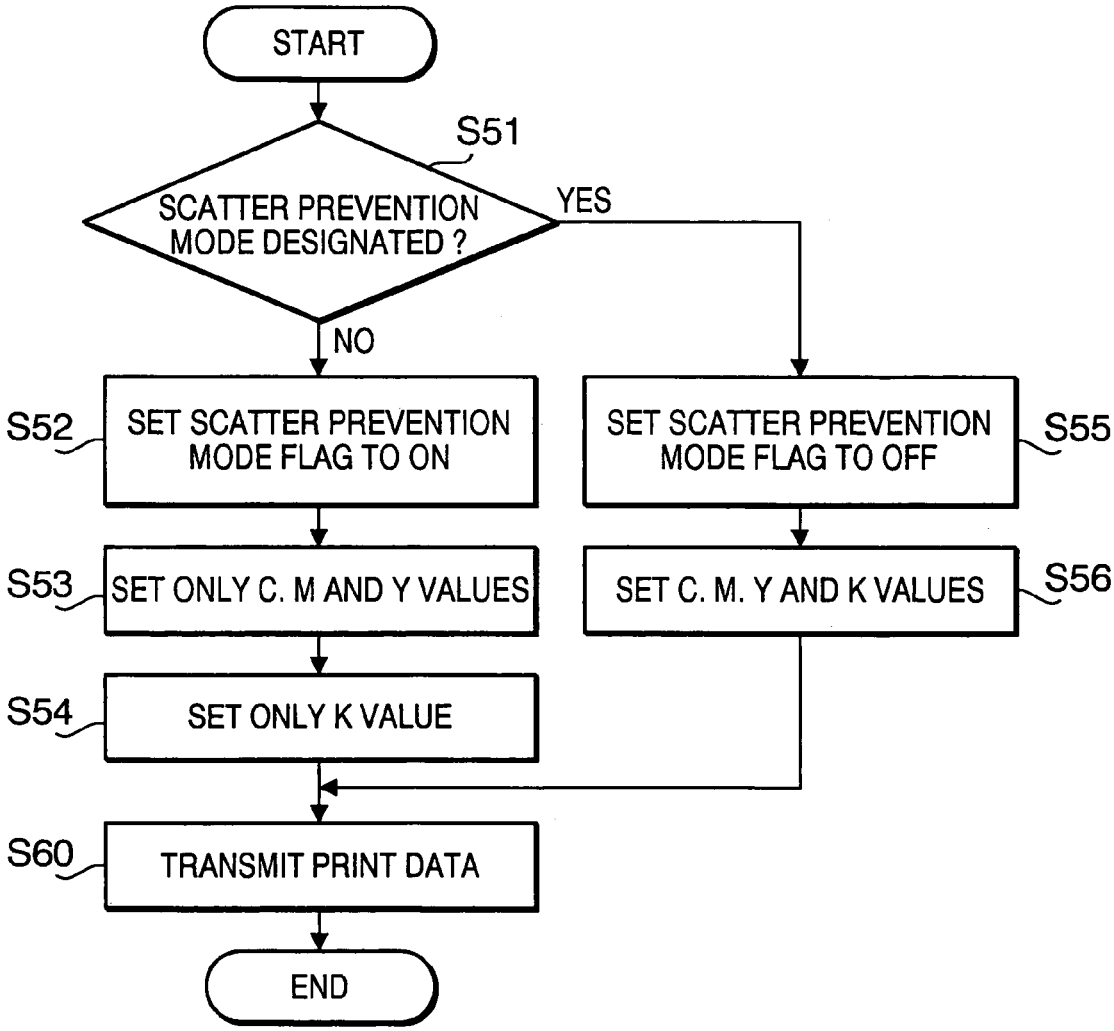

FIG. 4 schematically shows storage areas of a ROM;

FIG. 5 schematically shows storing areas of a RAM;

FIG. 6 is a block diagram showing an electrical configuration of a personal computer to be connected with the inkjet recording device shown in FIG. 1;

FIG. 7 schematically shows storing areas of a RAM of the personal computer shown in FIG. 6;

FIG. 8 schematically shows storing areas of an HDD of the personal computer shown in FIG. 6;

FIG. 9 is a flowchart illustrating a print procedure according to a first embodiment of the invention;

FIG. 10 schematically shows an exemplary configuration of print data;

FIG. 11 shows an exemplary window through which a print operation is initiated;

FIG. 12 is a flowchart illustrating a print data creating procedure according to a second embodiment; and FIG. 13 is a flowchart illustrating a print procedure according to the second embodiment of the invention.

DETAILED DESCRIPTION OF THE EMBODIMENTS

Referring now to the accompanying drawings, inkjet recording devices according to embodiments of the invention will be described.

FIG. 1 is a perspective view schematically showing an entire configuration of an inkjet recording device 1 to which the present invention is applicable. The inkjet recording device 1 is connected with a personal computer (PC) 200 (see FIG. 6). The inkjet recording device 1 receives print data, which is created by the PC 200 and transmitted therefrom, and prints out an image corresponding to the print data as received. According to the embodiments, the inkjet recording device 1 is a color recording device using four colors (Cyan, Magenta, Yellow and Black) of ink.

According to the embodiments, scatter of the ink, in particular, the scatter of black ink in the yellow image is prevented by controlling the order of ejecting the ink.

In a first embodiment, a scatter prevented print mode selecting member is provided to allow a user to select a scatter prevented print mode. When such a mode is selected, based on print data transmitted from the personal computer 200, the inkjet recording device 1 forms an image using only cyan, magenta and yellow inks. Thereafter, the printer refers to the print data again and form a black component image from the beginning. In the following description, a print mode without the above-described control will be referred to a normal print mode.

Now, FIG. 1 will be described in detail. The inkjet recording device 1 has a housing 2 having a substantially rectangular solid shape. In FIG. 1, for the sake of explanation, side walls and upper wall of the housing are not shown. The housing 2 has a longer side on a right-and-left direction in FIG. 1. The inkjet recording device 1 is provided with a platen driving mechanism 6, which is configured as follows. Substantially at the center of the bottom surface of the housing 2, a pair of rails 3 extending in front-and-rear direction are provided. The pair of rails 3 are supported on a base (not shown) protruded from the housing 2. The pair of rails 3 support a platen support (not shown), which is a flat plate member, thereon so as to movable in the front-and-rear direction of the inkjet recording device 1 along the pair of rails 3. A supporting pillar is provided to vertically stand on the platen support, and a platen 5 is secured on the upper end of the supporting pillar. The platen 5 is exchangeable with respect to the platen support.

The platen 5 is a plate member having a substantially rectangular shape viewed from the top, having longer sides extending in the front-and-rear direction. On the platen 5, a substrate, or a recording medium, e.g., fabric such as a T-shirt is placed horizontally and held flat and stably. On the upper surface of the platen 5, an antislip member is provided to prevent slippage of the substrate.

A tray 4 is fixed to the pillar at a substantially intermediate position between the platen 5 and platen support. The tray has a lower surface which is substantially parallel with the upper surface of the platen 5. When viewed from the top (i.e., the platen side), the tray 4 is slightly larger than the platen 5. The tray 4 is used to protect the substrate. For example, when the user placed a T-shirt on the platen 5, the tray 4 receives sleeves of the T-shirt so that the sleeves do not contact the bottom surface of the housing 2.

On a rear side of the platen driving mechanism 6 described above, a platen driving motor 7, which is a stepping motor, is provided. As the platen driving motor 7 is actuated, the platen support moves in the front-and-rear direction along the pair of rails 3. Specifically, between a driving shaft of the platen driving motor 7 and a pulley (not shown) provided in the vicinity of the front ends of the rails 3 (i.e., the ends of the rails 3 on the front end side of the housing 2), a driving belt (not shown) is wound, the platen support being secured to the driving belt. Thus, when the platen driving motor 7 is actuated and the driving shaft thereof rotates, the driving belt moves, and the platen support secured to the belt moves as guided by the pair of rails 3, in the front-and-rear direction of the housing 2.

Figure 2:
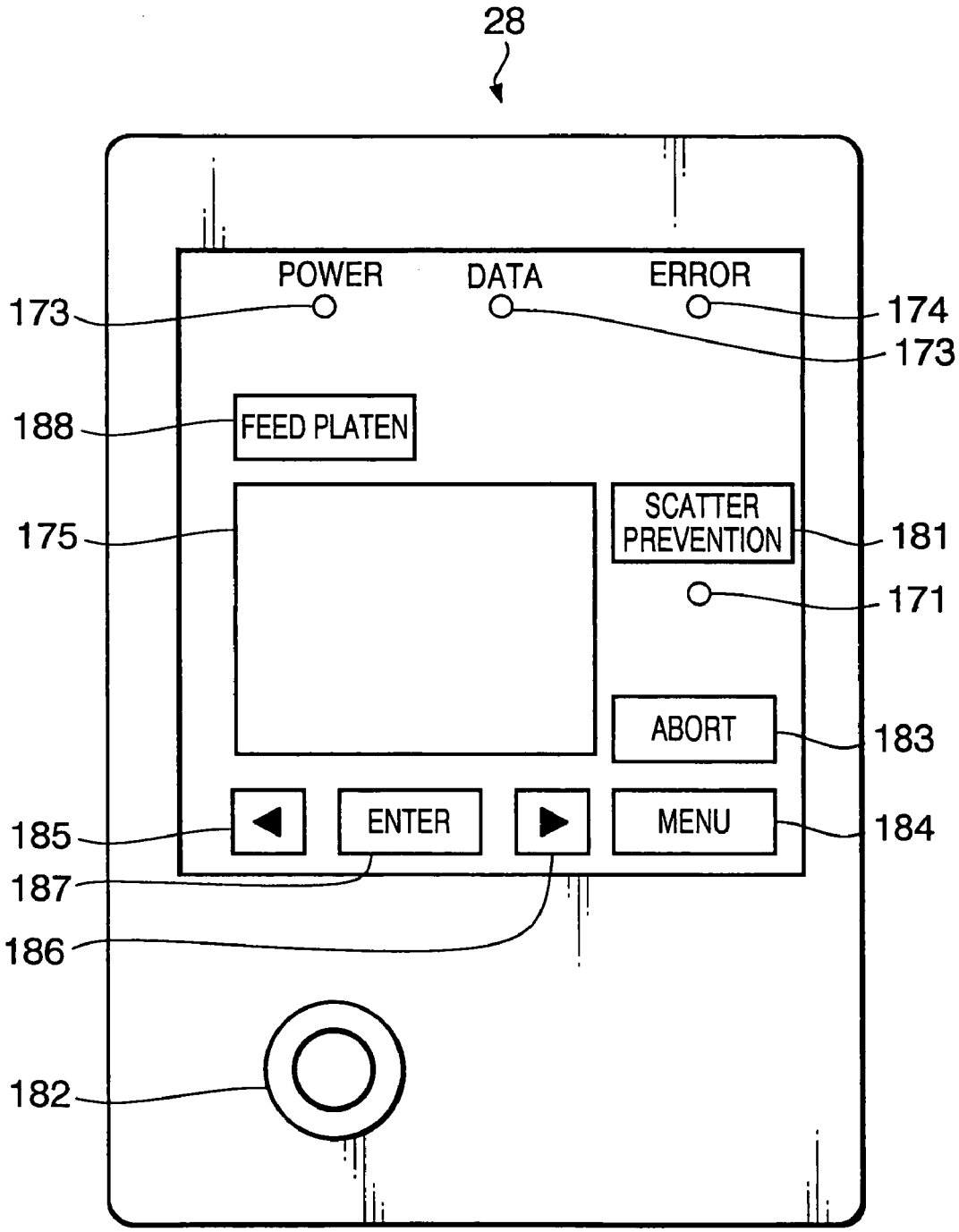
FIG. 2 shows a top view of an operation panel of the inkjet recording device shown in FIG. 1.

Further, a guide rail 9 is provided so as to be bridged between left-hand side wall and right-hand side wall (not shown) of the housing 2, at a substantially central position in the front-and-rear direction of the housing 2 and above the platen 5. A carriage motor 24 is provided in the vicinity of the left-hand side end of the guide rail 9. A pulley 25 is provide in the vicinity of the right-hand side end of the guide rail 9, and a carriage belt 26 is wound between a driving shaft of the carriage motor 24 and the pulley 25. As shown in FIG. 2, the carriage belt 26 extends in the right-and-left direction of the housing 2, below the guide rail 9. A rear surface of the carriage 20 is secured to the carriage belt 26. Further, on the rear surface of the carriage, an engaging section which slidably engages with the guide rail 9 is formed. The right-and-left movement of the carriage 20 is guided by the guide rail 9. Accordingly, when the carriage motor 24 is driven, the carriage 20 is moved in the right-and-left direction of the housing 2 as guided by the guide rail 9. In this embodiment, the carriage motor 24 is a DC motor. A well-known linear encoder (not shown) is provided to the guide rail 9, and a position in the right-and-left direction of the carriage 20 is detected using the linear encoder.

The inkjet recording device 1 uses the cyan ink, magenta ink, yellow ink and black ink. On a left-hand side surface of the inkjet recording device 1, ink cartridge containers 30*a*, 30*b*, 30*c* and 30*d* are provided. Specifically, as shown in FIG. 1, the ink cartridge containers 30*a*, 30*b*, 30*c* and 30*d* are arranged in this order from the front side to the rear side of the housing 2. The black, cyan, magenta and yellow ink cartridges are detachably accommodated in the ink cartridge containers 30*a*–30*d*, respectively.

To the ink cartridge containers 30*a*–30*d*, ink supply tubes 10*a*, 10*b*, 10*c* and 10*d* are respectively connected. The ink supply tubes 10*a*–10*d* run in the housing 2 though a guide member 40 and a tube supporting member 60, and are connected to inkjet heads 21*a*, 21*b*, 21*c* and 21*d* for respective color components. The ink supply tubes 10*a*–10*d* are flexible tubes made of resin (e.g., polyethylene) so that each of can easily be bent or twisted as the carriage 20 moves. The guide member 30 is located at substantially intermediate position in the right-and-left direction of the housing 2 and above the platen 5, and supports the four ink supply tubes 10*a*–10*d* as shown in FIG. 1. The tube support member 50 is provided on the upper surface of the carriage 20 to support the four ink supply tubes 10*a*–10*d*.

On the carriage 20, inkjet heads 21*a*, 21*b*, 21*c* and 21*d* are mounted in this order from the left-hand side to the right-hand in FIG. 1. Each of the inkjet heads 21*a*–21*d* has 128 ejection channels (not shown) through which the ink is ejected. To the ejection channels, piezoelectric actuators (not shown) are provided, respectively. The piezoelectric actuators are driven individually so that drops of ink are ejected downward from minute ink ejection nozzles provided on the lower surface of the inkjet heads 21*a*–21*d*, corresponding to the ink ejection channels, respectively.

With the above structure, the black ink stored in the ink cartridge container 30*a* is supplied to the inkjet head 21*a* through the ink supply tube 10*a*, and then ejected through the ink ejection nozzles. Similarly, the cyan ink stored in the ink cartridge container 30*b* is supplied to the inkjet head 21*b* through the ink supply tube 10*b*, and then ejected through the ink ejection nozzles. The magenta ink stored in the ink cartridge container 30*c* is supplied to the inkjet head 21*c* through the ink supply tube 10*c*, and then ejected through the ink ejection nozzles. Further, the yellow ink stored in the ink cartridge container 30*d* is supplied to the inkjet head 21*d* through the ink supply tube 10*d*, and then ejected through the ink ejection nozzles.

At a position, inside the housing 2, corresponding to the right-hand side end portion of the guide rail 9, a purge unit 22 is provided. The purge unit 22 has suction caps 23 which can be closely contacted or spaced away with respect to the nozzle surfaces of the inkjet heads 21*a*–21*d*, respectively. The purge unit 22 includes a suction pump (not shown), and when the suction caps 23 closely contact the inkjet heads 21*a*–21*d*, suction of the ink through the suction caps 23 can be performed. Additionally, when the printing operation is not carried out, the suction caps 23 cover the nozzle surfaces of the inkjet heads 21*a*–21*d* to prevent the ink from being dried.

At a position in front of the guide rail 9, a clearance sensor 8 extending in the right-and-left direction of the housing 2 is provided. The clearance sensor 8 functions, when the platen 5 moves along the pair of rails 3 in the front-to-rear direction, to detect wrinkles of the substrate placed on the platen 5 and/or obstacles such as dust.

On the right-front side portion of the housing 2, an operation panel 28 for operating the inkjet recording device 1 is provided. FIG. 2 shows a top view of the operation panel 28 of the inkjet recording device 1.

As shown in FIG. 2, on an upper portion in FIG. 2, there are power light 172, data light 173 and error light 174. The power light 172 is ON when power is supplied to the inkjet recording device 1. The data light 173 is ON when the inkjet recording device 1 is receiving print data from the personal computer 200. The error light 174 is ON when an error has occurred.

Below the power light 172 in FIG. 2, a platen feed button 188 is provided. When the platen feed button 188 is depressed, the platen is moved to a position at which the user can set/remove the substrate (e.g., fabric such as the T-shirt).

Further below the platen feed button 188 in FIG. 2, a display 175 is provided. The display 175 is for displaying various messages including a message indicating a standby state after reception of print data, a message indicating that print data is being received from the personal computer 200, a message indicating that the print data is being printed or completion of printing, The display 175 can also display a size and/or a name of the print data. Further, a menu screen to be used to input various settings. An error message can also be displayed when an error has occurred.

Below the display 175 in FIG. 2, left arrow button 185, enter button 187 and right arrow button 186 are provided in this order from the left-hand side to the right-hand side in FIG. 2. Next to the right arrow button 186, on the right-hand side in FIG. 2, a menu button 184 is provided. When the menu button 184 is depressed, a menu image is displayed on the display 175. By depressing the left arrow button 185, a cursor displayed on the display 175 is moved to left, while the right arrow button 186 is depressed, the cursor is moved to right on the display 175. When the enter button 187 is depressed, an item on which the cursor is located (and maybe highlighted) is selected.

Below the operation panel 28 in FIG. 2, a start button 182 to initiate the print operation is provided. Above the menu button 184 in FIG. 2, a stop button 183 is provided. When the start button 182 is depressed, printing of the print data received from the personal computer 200 is started. During the printing operation, by depressing the stop button 183, the printing operation is stopped.

On a right-hand side of the display 175 in FIG. 2, a scatter prevention mode setting button 181 and a scatter prevention mode light 171 are provided. The scatter prevention mode light 171 is ON when the scatter prevention mode is set (i.e., when the inkjet recording device 1 operates in the scatter prevention mode). When the scatter prevention mode setting button 181 is depressed when the inkjet recording device 1 operates in the normal print mode, the mode is switched to the scatter prevention mode. When the inkjet recording device 1 operates in the scatter prevention mode, by depressing the scatter prevention mode setting button 181, the mode is switched to the normal print mode.

Figure 3:
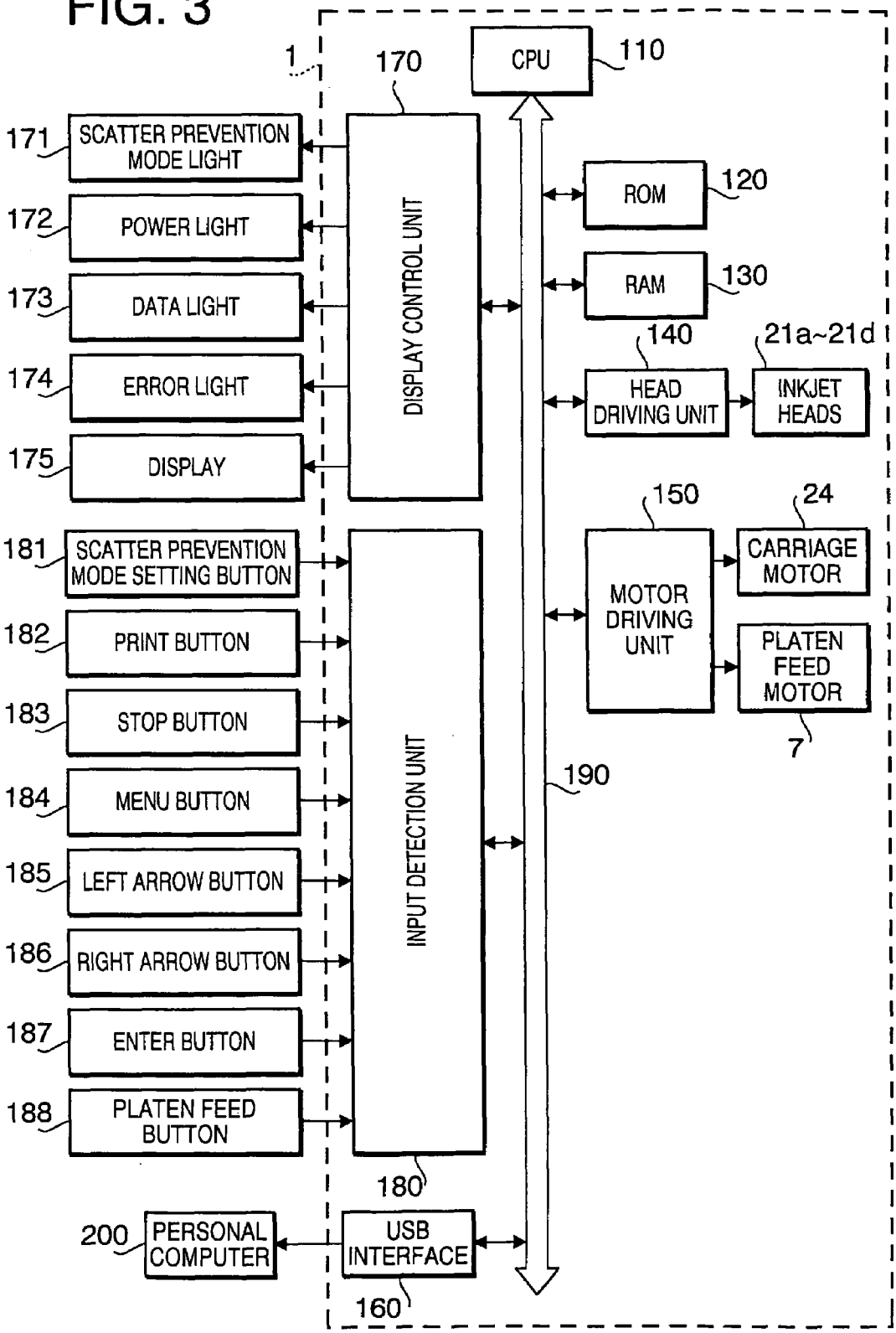
FIG. 3 is a block diagram showing an electrical configuration of the inkjet recording device shown in FIG. 1.

Next, referring to FIG. 3, an electrical configuration of the inkjet recording device 1 will be described. FIG. 3 is a block diagram showing the electrical configuration of the inkjet recording device 1. Further, FIG. 4 schematically shows storing areas of a ROM 120 and FIG. 5 schematically shows storing areas of a RAM 130.

As shown in FIG. 3, the inkjet recording device 1 includes a CPU (Central Processing Unit) 110 that controls the entire operation of the inkjet recording device 1. Via a bus 190, the CPU 110 is connected with the ROM 120 storing control programs to be executed by the CPU 110, and the RAM 130 temporarily storing various data.

Further, the CPU 110 is connected, via the bus 190, a head driving unit 140, a motor driving unit 150 and a USB (Universal Serial Bus) interface 160. The head driving unit drives piezoelectric actuators (not shown) respectively provided to the ejection channels of the inkjet heads 21*a*–21*d*. The motor driving unit 150 the carriage motor 24 that drives the carriage 20 mounting the inkjet heads 21*a*–21*d*, and the platen driving motor 7 that drives a platen roller (not shown), which controls speed and timing of driving the platen 5 for holding the substrate (e.g., fabric such as the T-shirt). The USB interface 160 enables the inkjet recording device 1 to perform a data communication with external devices including the personal computer 200, which are connected to the inkjet recording device 1 through a USB cable (not shown).

Further, a display control unit 170 is connected to the CPU 110 via the bus 190. The display control unit 170 is for controlling the display 175 and the status of each of the scatter prevention mode light 171, power light 172, data light 173 and error light 174. An input detection unit 180 is also connected to the CPU 110 via the bus 190. The input detection unit 180 detects input of each of the scatter prevention mode setting button 181, start button 182, stop button 183, menu button 184, left arrow button 185, right arrow button 186, enter button 187 and platen feed button 188.

As shown in FIG. 4, the ROM 120 has a program storage area 121 for storing control programs of the inkjet recording device 1 and print execution program to execute the printing operation, and an information storage area 122 for storing settings and initial values necessary to execute respective programs and various data. The ROM 120 further includes various storage areas, which are not indicated in FIG. 4 for brevity.

As shown in FIG. 5, the RAM 130 has a received data storage area 131 for storing the print data received form the external device (e.g., the personal computer 200), a current data storage area 132 for storing the print data currently being processed (printed), and a setting information storage area for storing various setting information. The RAM 130 is further provided with various data storage areas, which are not indicated in FIG. 5 for brevity.

FIG. 6 is a block diagram showing an electrical configuration of the personal computer 200, which can be connected to the inkjet recording device 1. FIG. 7 schematically shows storing areas of a RAM 230 of the personal computer 200, and FIG. 8 schematically shows storing areas of an HDD (Hard Disk Drive) 250 of the personal computer 200.

The personal computer 200 is connectable to the inkjet recording device 1 via a communication cable, such as the USB cable, according to a predetermined communication standard. According to the embodiment, print data is generated based on image data created with graphic software, scanned by a scanner, captured by a digital camera etc., and the thus generated print data is transmitted from the personal computer 200 to the inkjet recording device 1.

As shown in FIG. 6, the personal compute 200 has a CPU 210, and a ROM 220, a RAM 230, a CD-ROM drive 240, the HDD 250, a USB interface 260, a display control unit 270 and an input detection unit 280 are connected to the CPU 210 via a bus 290.

The ROM 220 stores programs including BIOS to be executed by the CPU 210. The RAM 230 temporarily stores various data. The CD-ROM drive 240 is used when data is retrieved from a CD-ROM 241. The HDD 250 is used for storing various data. The USB interface 260 enables the personal computer 200 to perform data communication with other devices including the inkjet recording device 1. The display control unit 270 controls the monitor 271, on which an operation screen is displayed. The input detection unit 280 is connected with a keyboard 281 and a mouse 282, through which the user can input commands and the like. Although not indicated in FIG. 6, the personal computer 200 is provided with a floppy® disk drive, a sound I/O (input/output) unit, and various interfaces.

According to the embodiment, in the CDROM 241, a print data creating program and settings and data when the print data creating program is executed are stored. When necessary, the print data creating program and the settings and data are retrieved from the CD-ROM 241 and stored in a program storage area 251 and program-related data storage area 252 of the HDD 250 (see FIG. 8). It should be noted that the print data creating program and data therefor are not limited to those stored in the CD-ROM 241. Such a configuration is only an exemplary one, and the program and data may be stored in another storage medium such as the floppy® disk or MO (Magneto-Optical disk), or may be obtained through a network such as the Internet if the personal computer 200 is connectable to such a network.

As shown in FIG. 7, the RAM 230 has a input image data storage area 231 for temporarily storing image data from which print data is created, a print data storage area 232 for storing the print data which is created, based on the image data, by the print data creating program, and data storage area 233 for temporarily storing data during execution of the print data creating program. The RAM 230 has further storage areas storing various data, which are not indicted in FIG. 7 for brevity.

As shown in FIG. 8, the HDD 250 has a program storage area 251 for storing various programs including the print data creating program to be executed by the CPU 210, a program-related data storage area 252 for storing various settings, initial values and data such as a color conversion table necessary for executing the programs, and an image data storage area 253 for storing the image data. The HDD 250 has further storage areas storing various data, which are not indicated in FIG. 8 for brevity.

In the inkjet recording device 1 according to the first embodiment of the invention, when the print data creating program is executed in the personal computer 200 and the created print data is transmitted from the personal computer to the inkjet recording device 1, the data light 173 is ON to indicate that the data is being received, and information regarding the print data as received is displayed on the display 175. After the print data has been received, and when an operator sets, for example, a T-shirt on the platen 5 and depresses the start button 182, the platen 5 is moved to rearward position of the housing 2 along the pair of rails 3 as the platen drive motor 7 is driven so that the carriage 20 is located at an initial position for recording. Then, the carriage 20 moves from the right-hand position to the left-hand position in FIG. 1 with ejecting ink drops from the inkjet heads 21*a*–21*d* in accordance with recording instructions to perform one line recordation. Thereafter, the platen 5 is moved forward by one line amount. Then, the carriage 20 is moved from the left-hand side to the right-hand side to form another line on the T-shirt. Then, the platen 5 is moved forward by one line. The similar operation is repeated to form an entire image on the T-shirt. After the printing operation is finished, the platen 5 is fed to a position where the operator can remove the T-shirt therefrom. Then, the operator removes the T-shirt on which the image has been printed from the inkjet recording device 1. It should noted that a height (i.e., distance in the front-to-rear direction) of a "line" which is formed as the carriage 20 scans once (i.e., moves from right to left or left to right with ejecting the ink from the inkjet heads 21*a*–21*d*) can be one pixel or a plurality of pixels.

The "scatter" of the ink of the image formed by the inkjet printer occurs due to the following reason. When an ink drop ejected from the inkjet heads 21*a*–21*d* reaches the substrate, the ink scatters around a position where the ink drop has reached. The reached and/or scattered ink drops are put on other ink drops which have already reached on the substrate, and spread among the ink drops already on the substrate.

In particular, in the inkjet recording device 1 for fabric such as the T-shirt, in order to realize the coloring as beautiful as possible, a relatively large ink drop (e.g., 40 picoliters) in comparison with that for paper (e.g., 2 picoliters) is used. Therefore, the scattered ink drops when the ejected ink drop has reached the substrate have a relatively large size and tend to be conspicuous. Further, when the substrate is fabric, which is woven material, a certain textile such as the unevenness of the fiber itself and/or the unevenness of height due to the weave is formed. When the ink drops ejected from the inkjet heads 21*a*–21*d* reach such surface of the fabric, the ink drops are struck onto such textile. Therefore, the amount of the ink drops scatter on the surface of the fabric is relatively large, which results in conspicuousness of the scattered ink drops.

As aforementioned, the inkjet recording device 1 forms an image using four color inks: cyan ink; magenta ink, yellow ink; and black ink. When a part of an image is formed using only the yellow ink, and black ink drops are scattered on such a yellow image, the scatter is very conspicuous, as a combination of black and yellow is often used in daily life to notify warning condition. In a conventional inkjet recording device, during one scan of the carriage, all the inkjet heads for ejecting all the color components are driven to eject ink drops. Therefore, if yellow ink drops are ejected on fabric and exist thereon unstably, and black ink drops scatter thereon, the black ink may spread in or among the yellow ink drops, which can be easily recognized as scattered ink drops.

In view of the above, the inkjet recording device 1 according to the first embodiment is operable in the scatter prevention print mode or the normal print mode. In the normal print mode, all the inkjet heads 21*a*–21*d* are controlled to eject ink drops during one scan of the carriage 20, which is a control similar to the control of the conventional inkjet recording device. In the scatter prevention print mode, in order to provide a sufficient time duration between a time when the yellow ink drops reach the substrate and a time when the black ink drops reach the substrate, since the combination of the yellow and black should be avoided. For this purpose, the printing operation is divided into two stages. At a first stage, only the three inkjet heads: the inkjet head 21*b* for the cyan ink; the inkjet head 21*c* for the magenta ink; and the inkjet head 21*d* for the yellow ink are driven, based on the print data, but to execute the printing operation on the substrate only for the cyan, magenta and yellow components. Thereafter, the platen 5 is returned to a print initial position. Then, a second stage starts, and the inkjet head 21*a* for the black ink is driven, based on the print data, to execute another printing operation only for the black component. With the above control, since the yellow ink drops have reached the surface of the substrate in the first stage, when the black ink drops are ejected, the yellow ink drops become sufficiently stable on the substrate and well permeated in the substrate, the black ink drops scattered on the yellow ink drops hardly spread in or among the yellow ink drops. Thus, the "scattered phenomenon" can be well suppressed.

It should be noted that, by operating the scatter prevention mode setting button 181, the scatter prevention mode is set. When the scatter prevention mode is selected, the scatter prevention mode light 171 is ON, which is turned off when the normal print mode is selected. As an example, the substrate is a 100% cotton T-shirt (e.g., Beefy-T® made by Hanes®).

The black ink has low L* value (brightness). There exists a difference among L* values depending on the type and manufacturer of the black ink. However, when the printed black ink on the cotton 100% T-shirt is measured with a spectrophotometric colorimeter CM-3700d made by Konica-Minolta, the L* value of the black ink is 30 or thereabout. On the other hand, the L* value of the yellow ink is relatively high. Similar to the black ink, there exits a difference among L* values depending on the type and manufacturer, the measured L* value is 80 or thereabout. The L* value of the cyan ink and the magenta ink is typically a value greater than 40 and lower than 60.

According to the first embodiment, in the scatter prevention print mode, the printing is performed using the cyan ink, magenta ink and yellow ink each of which has the L* value greater than 40 in the first stage. Then, in the second stage, the printing operation is performed using the black ink which has the L* value equal to or less than 40.

FIG. 9 is a flowchart illustrating a print procedure according to the first embodiment of the invention. The procedure is started when the operator depressed the start button 18 under a condition in which the inkjet recording device 1 is ready to execute the printing operation. The condition includes (a) no printing operations being executed at the time, (b) print data to be processed (printed) is stored in the received print data storage area 131 and (c) a substrate (i.e., a media on which an image is printed) is correctly set to the platen 5. In the following description, cyan, magenta and yellow will be referred to as C, M and Y.

When the print procedure is started, initialization of the print data is executed in S1. Specifically, in the initializing step, the print data stored in the received print data storage area 131 is transferred to the current data storage area 132 and the print data stored in the received print data storage area is deleted. Then, control opens the file of the print data to retrieve the print data stored in the current data storage area 132. Next, control reads header information, and displays the information of the print data and a message indicating that printing is being executed on the display 175 (S2). In S3, control moves the platen 5 to a print start position.

In S4, control judges whether the operation mode of the inkjet recording device 1 is the scatter prevention mode. This judgment is done based on whether the scatter prevention mode flag in the setting information storage area 133 of the RAM 130 is set to one (1) which means the scatter prevention mode is ON or set to zero (0) which means the scatter prevention mode is OFF. The scatter prevention mode flag is toggled between zero and one upon each depression of the scatter prevention mode setting button 181. Specifically, when control detects depression of the scatter prevention mode setting button 181 when the scatter prevention mode flag is zero (i.e., the mode is OFF), control sets the scatter prevention mode flag to one (i.e., the mode is ON), and turns on the scatter prevention mode light 171. When control detects depression of the scatter prevention mode setting button 181 when the scatter prevention mode flag is one (i.e., the mode is ON), control sets the scatter prevention mode flag to zero (i.e., the mode is OFF), and turns off the scatter prevention mode light 171.

According to the embodiment, when the scatter prevention mode flag is not one, that is, when the operation mode is not the scatter prevention mode (S4: NO), the operation mode is the normal print mode. In this case, control proceeds to S21 and the printing operation in the normal print mode is executed.

When the printing operation is executed in the normal print mode, control firstly retrieves print data for one line (S21). If the print data for one line has been retrieved (S22: YES), control actuates all of the inkjet head 21*a* for the K component, the inkjet 21*b* for the C component, the inkjet head 21*c* for the M component and the inkjet head 21*d* for the Y component, and the printing operation for the line is executed (S23). Then, control returns to S21 and retrieves the print information for the next line (S21). If the print data is retrieved (S22: YES), steps S23, S21 and S22 are repeated as above. When the printing operation has been executed for all the lines, no print data for one line is retrieved in S21 and control determines that the print data for one line has not been retrieved (S22: NO). Then, control proceeds to S31, where the platen 5 is fed to its ejected position (S31) at which the operator can remove the substrate set onto the platen 5, and control executes the print end process (S32). In the print end process, the print data is closed and a message indicating the completion of print is displayed on the display 175.

When the scatter prevention mode flag is one, that is, when the operation mode is the scatter prevention mode (S4: YES), control proceeds to S5 and the printing operation in the scatter prevention mode is executed.

When the printing operation is executed in the scatter prevention mode, control firstly retrieves print data for one line (S5). If the print data for one line has been retrieved (S6: YES), control actuates the inkjet 21*b* for the C component, the inkjet head 21*c* for the M component and the inkjet head 21*d* for the Y component, and the printing operation for the line is executed (S7). Then, control returns to S5 and retrieves the print data for the next line (S5). If the print data is retrieved (S6: YES), steps S7, S5 and S6 are repeated as above.

When the printing operation for the C, M and Y components has been executed for all the lines, no print data for one line is retrieved in S5 and control determines that the print data for one line has not been retrieved (S6: NO). Then, control proceeds to S8, where a reprint preparation process is executed. In S8, since all the lines of the C, M and Y have been printed, the print data file is closed and then it is reopened for the black component. Further, the head information is retrieved again. Next, the platen is returned to the print start position (S9).

Next, control retrieves print data for one line (S9). If the print data for one line has been retrieved (S10: YES), control actuates the inkjet 21*a* for the K component, and the printing operation for the line is executed (S12). Then, control returns to S10 and retrieves the print data for the next line (S10). If the print data is retrieved (S11: YES), steps S12, S10 and S11 are repeated as above. When the printing operation has been executed for all the lines, no print data for one line is retrieved in S10 and control determines that the print data for one line has not been retrieved (S11: NO). Then, control proceeds to S31, where the platen 5 is fed to its ejected position (S31), and control executes the print end process (S32). In the print end process, as described above, the print data is closed and a message indicating the completion of print is displayed on the display 175.

Accordingly, by operating the scatter prevention mode setting button 181, the operator can select the scatter prevention mode or the normal print mode. When the scatter prevention mode is selected, based on the print data created by the personal computer 200, the inkjet recording device 1 prints the image of C, M and Y components each of which has L* value equal to or less than 40 at the first stage. Then, the inkjet recording device 1 prints the K component of the same image on the C, M and Y component image. Since the K ink drops reach the substrate after the C, M and Y ink drops have reached and become stable on the substrate, the blot or spread of the K ink in and/or among the C, M and Y ink can be well suppressed.

In the inkjet recording device 1 as described above, a color of one pixel of an image is expressed by four colors (K, C, M and Y). Since the inks for four colors are ejected from four different inkjet heads, the four color ink drops for the same pixel are not ejected at the same time in a precise sense. However, since the carriage 20 moves at a high speed when the ink drops are ejected from the inkjet heads 21*a*–21*d* mounted thereon, when the scatter of the ink is considered, it may be appropriate to consider that the ink drops of four colors for the same pixel are ejected substantially simultaneously. Further, when a target pixel to which the ink drops are ejected, scattered ink drops reach pixels in the neighborhood of the target pixel. For such pixels within a range in which the ink drops directed to the target pixel scatter, it is regarded that the ink drops are ejected substantially simultaneously with the ejection of the ink drops to the target pixel.

When the printing operation is executed in the scatter prevention mode, the ink drops corresponding to the ink whose L* value equal to or less than 40 are ejected predetermined period after the ink drops corresponding to the ink whose L* value exceeds 40. It should be noted that the "predetermined period" should not be regarded as a time duration between ejections of ink to a certain pixel during one scan of the carriage 20. Rather, the "predetermined period" should be regarded as a time duration between the printing operation at the first stage (i.e., image formation using inks whose L* value is greater than 40 during a first scan of the carriage) and that at the second stage (i.e., image formation using the ink whose L* value is equal to or less than 40 in the second scan of the carriage 20).

It should be noted that the present invention should not be limited to the configuration described above as the first embodiment, and various modification can be made without departing the scope of the invention.

According to the first embodiment, the inkjet recording device 1 carries out the printing operation by ejecting the ink drops from the inkjet heads 21*a*–21*d* each time when the carriage 20 moves both directions (i.e., from the right-hand side to the left-hand side, and from the left-hand side to the right-hand side of the housing 2). This control is only an example, and the inkjet heads may be driven only when the carriage move in one direction.

In the first embodiment, the color image is formed in accordance with the CMYK method (i.e., using the C, M, Y and K inks). However, the number of ink colors is not limited to four and the invention can be applied in a system using a more number of ink colors.

According to the first embodiment, when the printing operation is executed in the scatter prevention mode, after the printing in accordance with the entire print data using the C, M and Y inks (having the L* value exceeding 40) is finished, the printing in accordance with the entire print data using the K ink (having the L* value equal to or less than 40) is performed. In this case, the "predetermined period" is equal to a time period necessary for printing one piece of image data. This may be modified such that the C, M and Y components (having the L* value exceeding 40) are printed in a first half (i.e., a forward movement) of the reciprocating (i.e., bi-directional) scanning movement of the carriage 20, and the K component (having the L* value equal to or less than 40) is printed in a second half (i.e., a reverse movement) of the reciprocating (i.e., bi-directional) scanning movement of the carriage 20. In such a case, the "predetermined period" or the difference between ink ejection times is regarded as a time duration necessary for changing the moving direction of the carriage 20.

In a further modification, the inkjet recoding device may be configured that the printing is executed only when the carriage 20 is moved in one direction. In such a case, after the C, M and Y components are formed for one line, the platen is moved back by an amount of one line (since the platen is normally fed by one line after image formation of one line), and the K component of the line is formed on the line. In such a case, the difference between the ink ejection times is regarded as a time duration necessary for one reciprocating movement of the carriage 20. Similar control may be executed for a plurality of lines. That is, firstly, the C, M and Y components of a plurality of lines are formed, and then, after moving back the platen 5 by the corresponding amount, the K component of the same lines are printed. In such a case, the time duration between the ink ejection times is regarded as a time duration necessary to print the plurality of lines.

In the first embodiment, the C, M and Y inks (whose L* values exceed 40) are ejected first, and the K ink (whose L* value is equal to or less than 40) is ejected later. This can be modified such that, only the Y ink (whose L* value is 60 or greater) is ejected first, and the C, M and K inks (whose L* values are less than 60) are ejected later. In this case, the procedure shown in FIG. 9 is modified such that only the inkjet head 21*d* for the Y ink is driven in S7, and the inkjet heads 21*a*, 21*b* and 21*c* for K, C and M inks are driven in S12.

Second Embodiment

Next, the inkjet recording system according to the second embodiment will be described. Since the electrical configuration of the inkjet recording device and an external device (e.g., a personal computer connected to the inkjet recording device) is substantially similar to that of the first embodiment, FIGS. 1 and 3–7 are referred to in the description below on the second embodiment.

According to the second embodiment, the personal computer 200 is provided with a scatter prevention mode selecting member. When the scatter prevention mode is selected, the personal computer 200 creates the print data as first data and second data. The first data is print data of an entire image (for all the pixels) for the C, M and Y components, while the second data is print data of an entire image for the K component. The inkjet recording device 1 only to carry out a printing operation in accordance with the first and second data, and does not control the inkjet heads 21*a* and 21*b*–21*d* separately.

When the scatter prevention mode is not selected in the personal computer 200, the normal print mode is selected, and the personal computer creates print data of an entire image (for all the pixels) for all the C, M, Y and K components. According to the second embodiment, since the scatter prevention mode is selected on the personal computer side, the scatter mode setting button 181 on the operation panel 28 is unnecessary.

FIG. 10 schematically shows an exemplary data structure of the print data 300 transmitted from the personal computer to the inkjet recording device 1. As shown in FIG. 10, at a top portion of the print data 300, as header data, the scatter prevention flag is set. If the scatter prevention flag is set to one (1), the scatter prevention mode is designated, while when the scatter prevention flag is set to zero (0), the normal print mode is designated. In the example shown in FIG. 10, the flag is set to one and the scatter prevention mode is designated.

In the example of FIG. 10, only the scatter prevention flag is shown as the header portion. However, in the actual print data further information regarding the print data (e.g., a type of the fabric as the target substrate, a file name of the image data, the size of the image data) is included, which is omitted in FIG. 10 for brevity.

The header of the data is followed by data regarding the printing of pixels follows. In the example shown in FIG. 10, for each pixel of the image, a location of the pixel (in a pixel column), and densities of color components for each pixel (i.e., C column, M column, Y column and K column) are designated. Thus, five columns (i.e., pixel column and C, M, Y and K columns) represent print data for one pixel. In the pixel column, the location of the pixel is indicated by X and Y coordinates (X, Y). In this example, X coordinate corresponds to a scan direction (i.e., a moving direction) of the carriage 20, and Y coordinate corresponds to the moving direction of the platen 5. The location of the upper left pixel of the image is indicated as (1, 1). Thus, a pixel on the right side of the image has a greater X coordinate value, and a pixel on the lower side has a greater Y coordinate value.

As shown in FIG. 10, in each of the C column, M column, Y column and K column, the thickness of the color component is indicated. In this example, pixel (1, 1) has values of 5 for C component, 22 for M component, 15 for Y component, and 0 for K component pixel (1, 6) has values of 9 for C component, 0 for M component, 90 for Y component, and 0 for K component. In FIG. 10, pixels (1, 7) through (300, 449) are omitted and pixel (300, 450) has values of 10 for C component, 7 for M component, 90 for Y component and 0 for K component. It should be appreciated that, when the scatter prevention mode is designated, all the K columns of the first data immediately following the header are set to zero. As shown in FIG. 10, second data which follows the first data has a similar structure of the first data but all the columns for M, C and Y components are set to zero, while K columns are set to values corresponding to the image. That is, pixel (1, 1) has a value of 85 for K component, pixel (1, 2) has a value of 1 for K component, etc. The remaining portion is omitted in FIG. 10 for brevity.

Next, referring to FIG. 11, a print start dialogue in which the scatter prevention mode can be designated will be described. FIG. 11 shows an exemplary window showing the print start dialogue 400 displayed on the monitor 271 of the personal computer 200. When the user operates the personal computer 200 to print an image, the dialogue 400 as shown in FIG. 11 is displayed, in which a message "Do you want to start printing?" and an indication of "Scatter prevention mode" and a check box 402 are displayed below the message. If an OK button 401 in the dialogue window 400 is clicked, a print data creating procedure (see FIG. 12) is executed, in which print data is created and transmitted to the inkjet recording device 1. It should be noted that in the exemplary dialogue window, further options such as the number of copies can be included.

Referring now to FIG. 12, the print data creating procedure according to the second embodiment will be described. FIG. 12 is a flowchart illustrating the print data creating procedure which is executed by the CPU 210 of the personal computer 200. The procedure starts when the operator clicks the OK button 402 of the print start dialogue 400 displayed on the monitor 271.

In S51, control judges whether the scatter prevention mode is selected. If the operator has checked the check box 401 of the print start dialogue 400, control determines, in S51, the scatter prevention mode is selected, and if not, control determines that the scatter prevention mode is selected.

If the scatter prevention mode is not selected (S51: NO), control sets the scatter prevention mode flag of the print data (see FIG. 10), which is created in the print data storage area 232 of the RAM 230, to zero (S55). Then, control sets, for all the pixels, all the columns of C, M, Y and K components to values corresponding to the image to be printed (S56). Then, in S60, control transmits the thus created print data to the inkjet recording device 1, and finishes the print data creation procedure.

If the scatter prevention mode is selected (S51: YES), control sets the scatter prevention mode flag of the print data (see FIG. 10) to one (S52). Then, control sets, for all the pixels, the columns of C, M and Y components to values corresponding to the image to be printed, while control sets all the K columns to zero to create the first data (S53). Next, control sets, for all the pixels, the columns of C, M and Y components to zero, and sets all the K columns to values corresponding to the image to create the second data (S54). Then, in S60, control transmits the created print data having the first data and second data to the inkjet recording device 1, and finishes the print data creation procedure.

As above, if the scatter prevention mode is designated by checking the check box 401 (see FIG. 11), the scatter prevention mode flag of the print data is set to one, and appropriate print data is automatically created.

The printing operation of the inkjet recording device 1 when the print data created as above is received will be described with reference to FIG. 13.

FIG. 13 is a flowchart illustrating a print procedure executed by the inkjet recording device 1. The procedure is started when the operator depressed the start button 182 under a condition in which the inkjet recording device 1 is ready to execute the printing operation. Similar to the first embodiment, the condition includes (a) no printing operations being executed, (b) print data to be processed (printed) is stored in the received print data storage area 131, and (c) a substrate (i.e., a media on which an image is printed) is correctly set to the platen 5.

When the print procedure is started, initialization of the print data is executed in S71. Specifically, in the initializing step, the print data stored in the received print data storage area 131 is transferred to the current data storage area 132 and the print data stored in the received print data storage area is deleted. Then, control opens the file of the print data to retrieve the print data stored in the current data storage area 132. Next, control reads header information. If the scatter prevention flag of the header is set to one (1), a scatter prevention mode flag in the setting information storage area 133 of the RAM is set to one (1), thereby the inkjet recording device 1 operates in the scatter prevention mode (S72). If the scatter prevention flag of the header is set to zero (0), the scatter prevention mode flag in the setting information storage area 133 of the RAM is set to zero (0), thereby the inkjet recording device 1 operates in the normal print mode (S72). Next, control displays a message indicating that printing is being executed on the display 175 (S73). Preferably, if the scatter prevention mode is selected, the mode is also indicated on the display 175 in S73.

In S74, control judges whether the operation mode of the inkjet recording device 1 is the scatter prevention mode. This judgment is done based on whether the scatter prevention mode flag in the setting information storage area 133 of the RAM 130 is set to one (1) or zero (0).

When the printing operation is executed in the normal print mode, that is, when the scatter prevention mode flag in the setting information storage area 133 is set to zero (S74: NO), normal print data (i.e., print data configured such that all of the C, M, Y and K components, for all the pixels, have values) is transmitted from the personal computer 200. In this case, control moves the platen 5 to the print start position (S81), and retrieves print data for one line (S82). If the print data for one line has been retrieved (S83: YES), control actuates all of the inkjet heads 21*a*–21*d*, and the printing operation for the line is executed (S84). Then, control returns to S82 and retrieves the print information for the next line (S82). If the print data is retrieved (S83: YES), steps S84, S82 and S83 are repeated as above. When the printing operation has been executed for all the lines, no print data for one line is retrieved in S82 and control determines that the print data for one line has not been retrieved (S83: NO). Then, control proceeds to S91, where the platen 5 is fed to its ejected position (S91) at which the operator can remove the substrate set onto the platen 5, and control executes the print end process (S92). In the print end process, the print data is closed and a message indicating the completion of print is displayed on the display 175.

When the scatter prevention mode flag in the setting information storage area 133 is set to one (S74: YES), print data for the scatter prevention mode print is transmitted from the personal computer 200. That is, the received print data includes the first data for printing the C, M and Y components, and the second data for printing the K component. In this case, the printing is firstly executed in accordance with the first data, and then, the platen 5 is returned to the initial position, and the printing is executed in accordance with the second data.

When the printing operation is executed in the scatter prevention mode, control firstly retrieves print data for one line (S75). If the print data for one line has been retrieved (S76: YES), control judges whether the retrieved data is the data for the first line of the image (S77). When S77 is executed first time, the retrieved data is the data of the first line (S77: YES), and control proceeds to S78, where the platen 5 is moved to the initial position (i.e., the print start position). Then, in S79, control executes the printing operation according to the first data. It should be noted that, in S79, the inkjet head 21*a* for the K component is also actuated as well as the inkjet heads 21*b*–21*d*. However, in the first data, all of the K columns are set to zero (see FIG. 10), and thus the K ink drops are not ejected from the inkjet head 21*a* during the printing operation according to the first data. After the first line is printed in S79, control returns to S75 and retrieves the print data for the next line (S75). If the print data is retrieved (S76: YES), control determines whether the retrieved data is for the first line of the image (S77). Since the data for the first line of the first data has been retrieved and printed (S77: NO), control proceeds to S79, and the printing operation according to the retrieved data is executed (S79). Thereafter, S75, S76 and S77 are repeated.

When the printing operation for the C, M and Y components has been executed for all the lines, i.e., the printing operation according to the first data has been finished, and S75 is executed, data corresponding to the first line of the image for the K component is retrieved (i.e., the data for first line of the second data is retrieved) in S75. In this case, control determines that the data is for the first line (S77: YES), the platen 5 is moved to the print start position (S78). Then, in S79, control executes the printing operation according to the second data (i.e., only for K component). It should be noted that, in S79, the inkjet heads 21*b*–21*d* are also actuated as well as the inkjet head 21*a* for the K component. However, in the second data, all of the C, M and Y columns are set to zero (see FIG. 10), and thus the C, M and Y ink drops are not ejected from the inkjet heads 21*b*–21*d* during the printing operation according to the second data.

After the first line, according to the second data, is printed in S79, control returns to S75 and retrieves the print data for the next line (S75). If the print data is retrieved (S76: YES), control determines whether the retrieved data is for the first line of the image (S77). Since the data for the first line of the first data has been retrieved and printed (S77: NO), control proceeds to S79, and the printing operation according to the retrieved data is executed (S79). Thereafter, S75, S76 and S77 are repeated.

As S75–S79 are repeated and all the lines of the image for the K component have been printed, no further data can be retrieved (S76: NO). Then, control proceeds to S91, where the platen 5 is fed to its ejected position (S91), and control executes the print end process (S92).

As above, when the printing operation is to be executed, if the check box 402 (see FIG. 11) for the scatter prevention mode is checked, the scatter prevention mode flag is set to one, and the first data having values of C, M and Y components is firstly created, followed by the second data having values of K component. If the check box 402 is not checked, the normal print mode is selected. In this case, the scatter prevention mode flag is set to zero, and the print data similar to conventional data is created, in which values of all of the C, M, Y and K components are given.

Further, the inkjet recording device 1 is configured to judge whether the scatter prevention mode is designated based on the scatter prevention mode flag of the print data transmitted from the personal computer 200. If the scatter prevention mode is designated, the inkjet recording device 1 executes the printing operation based on the first data (i.e., the data having values for the C, M and Y components). Thereafter, the platen 5 is returned to the print start position, and then the printing operation based on the second data (i.e., the data having values only for the K component) is executed. If the normal print mode is designated (i.e., the scatter prevention mode is not designated), the inkjet recording device 1 executes the printing operation based on the print data having values of all of the C, M, Y and K components, which is similar to the data of conventional printers. According to the second embodiment, since the K ink drops reach the substrate after the C, M and Y ink drops have reached and become stabled on the substrate, the blot or spread of the K ink in and/or among the C, M and Y ink can be well suppressed.

It should be noted that the present invention is not limited to the configuration described above as the second embodiment, and various modification can be made without departing the scope of the invention.

According to the second embodiment, the inkjet recording device 1 carries out the printing operation by ejecting the ink drops from the inkjet heads 21*a*–21*d* each time when the carriage 20 moves both directions (i.e., from the right-hand side to the left-hand side, and from the left-hand side to the right-hand side of the housing 2). This control is only an example, and the inkjet heads may be driven only when the carriage move in one direction.

In the second embodiment, the color image is formed in accordance with the CMYK method (i.e., using the C, M, Y and K inks). However, the number of ink colors is not limited to four and the invention can be applied in a system using a more number of ink colors.

According to the second embodiment, when the printing operation is executed in the scatter prevention mode, after the printing in accordance with the entire print data using the C, M and Y inks (having the L* value exceeding 40) is finished, the printing in accordance with the entire print data using the K ink (having the L* value equal to or less than 40) is performed. In this case, the "predetermined period" is equal to a time period necessary for printing one piece of image data. This may be modified such that the C, M and Y components (having the L* value exceeding 40) are printed in a first half of the reciprocating scanning movement of the carriage 20, and the K component (having the L* value equal to or less than 40) is printed in a second half of the reciprocating scanning movement of the carriage 20. In such a case, the "predetermined period" or the difference between ink ejection times is regarded as a time duration necessary for changing the moving direction of the carriage 20.

In a further modification, the inkjet recoding device may be configured such that the printing is executed only when the carriage 20 is moved in one direction. In such a case, after the C, M and Y components are formed for one line, the platen is moved back by an amount of one line (since the platen is normally fed by one line after image formation of one line), and the K component of the line is formed on the line. In such a case, the difference between the ink ejection times is regarded as a time duration necessary for one reciprocating movement of the carriage 20. Similar control may be executed for a plurality of lines. That is, firstly, the C, M and Y components of a plurality of lines are formed, and then, after moving back the platen 5 by the corresponding amount, the K component of the same lines are printed. In such a case, the time duration between the ink ejection times is regarded as a time duration necessary to print the plurality of lines.

In the second embodiment, the C, M and Y inks (whose L* values exceed 40) are ejected first, and the K ink (whose L* value is equal to or less than 40) is ejected later. This can be modified such that, only the Y ink (whose L* value is 60 or greater) is ejected first, and the C, M and K inks (whose L* values are less than 60) are ejected later. In this case, the procedure shown in FIG. 12 is modified such that only the values of the Y components are set in the first data and values for the M, C and K components are set in the second data (S53).

In the above-described embodiments and modifications, the inkjet recording system are described to include the inkjet recording device 1 and the personal computer 200. It should be appreciated that the inkjet recording device may be an inkjet printer, a color copier, a color facsimile device and a multi-function device having a combination of such devices.

What is claimed is:

1. An inkjet recording device that ejects a plurality of inks to form an image on a substrate, comprising:

a first ejecting system that operates to eject at least one ink whose color has a maximum L* value among the plurality of inks onto one or a predetermined number of lines on the substrate at a time;

a second ejecting system that operates to eject at least an ink whose color has a minimum L* value among the plurality of inks, the second ejecting system ejecting inks which are not ejected by the first ejecting system onto the same lines, onto which the first ejecting system has ejected the at least one ink whose color has the maximum L* value, at a time; and a controlling system that controls the first ejecting system and the second ejecting system such that the second ejecting system operates a predetermined period after the first ejecting system has operated sufficient to stabilize the at least one ink ejected by the first ejecting system whose color has the maximum L* value.

2. The inkjet recording device according to claim 1, wherein the first ejecting system ejects all of the inks whose colors have L* values greater than 40 among the plurality of inks; and wherein the second ejecting system ejects all of the inks whose colors have L* values equal to or less than 40 among the plurality of inks.

3. The inkjet recording device according to claim 2, wherein the inks whose colors have L* values equal to or less than 40 include a black ink.

4. The inkjet recording device according to claim 1, wherein the first ejecting system ejects all of the inks whose colors have L* values equal to or greater than 60 among the plurality of inks; and wherein the second ejecting system ejects all of the inks whose colors have L* values less than 60 among the plurality of inks.

5. The inkjet recording device according to claim 4, wherein the inks whose colors have L* values equal to or greater than 60 include a yellow ink.

6. The inkjet recording device according to claim 1, wherein the first ejecting system ejects only the ink whose color has the maximum L* value among the plurality of inks; and wherein the second ejecting system ejects all of the inks other than the ink whose color has the maximum L* value among the plurality of inks.

7. The inkjet recording device according to claim 1, wherein the first ejecting system ejects only the ink whose color has the maximum L* value among the plurality of inks; and wherein the second ejecting system ejects all of the inks other than the ink whose color has the maximum L* value among the plurality of inks.

8. An inkjet recording device that ejects a plurality of inks to form an image on a substrate, comprising:

a first ejecting system that operates to eject all of the plurality of inks except at least an ink whose color has a minimum L* value among the plurality of inks onto one or a predetermined number of lines on the substrate at a time;

a second ejecting system that operates to eject remaining inks which are not ejected by the first ejecting system onto the same lines, onto which the first ejecting system has ejected the inks, at a time; and a controlling system that controls the first ejecting system and the second ejecting system such that the second ejecting system operates a predetermined period after the first ejecting system has operated.

9. The inkjet recording device according to claim 8, wherein the first ejecting system ejects all of the inks whose colors have L* values greater than 40 among the plurality of inks; and wherein the second ejecting system ejects all of the inks whose colors have L* values equal to or less than 40 among the plurality of inks.

10. The inkjet recording device according to claim 9, wherein the inks whose colors have L* values equal to or less than 40 include a black ink.

11. The inkjet recording device according to claim 8, wherein the first ejecting system ejects all of the inks whose colors have L* values equal to or greater than 60 among the plurality of inks; and wherein the second ejecting system ejects all of the inks whose colors have L* values less than 60 among the plurality of inks.

12. The inkjet recording device according to claim 11, wherein the inks whose colors have L* values equal to or greater than 60 include a yellow ink.

13. An inkjet recording system, comprising:

an inkjet recording device that ejects a plurality of inks in accordance with print data to form an image on a substrate; and an external device that creates the print data for the inkjet recording device, the inkjet recording device that ejects at least an ink, whose color has a minimum L* value among the plurality of inks, at a predetermined period after ejection of at least an ink whose color has a maximum L* value to form a same line on the substrate formed by the ejection of at least an ink whose color has the maximum L* value, wherein the inkjet recording device includes:

a plurality of inkjet heads that eject the plurality of inks, respectively; and a controlling system that actuates, in accordance with the print data, all of the plurality of inkjet heads except at least an inkjet head corresponding to the ink whose color has the minimum L* value during a first stage and then, after a predetermined period sufficient to stabilize the ink, actuating remaining inkjet heads including the inkjet head corresponding to the ink whose color has the minimum L* value to form the same line on the substrate during a second stage.

14. The inkjet recording system according to claim 13, wherein the external device includes a print data creating system that creates first data in which at least print data corresponding to the ink having the minimum L* value is removed and second data in which print data corresponding to remaining inks including the ink whose color has the minimum L* value, and wherein the inkjet recording device operates in accordance with the second data predetermined after the inkjet recording device has operated in accordance with the first data.

15. A method of forming an image on a substrate by ejecting a plurality of inks, comprising:

a first step of ejecting at least one ink whose color has a maximum L* value among the plurality of inks onto one or a predetermined number of lines on the substrate at a time; and a second step of ejecting remaining inks which have not been ejected by the first step onto the same one or predetermined number of lines after a predetermined period sufficient to stabilize the at least one ink ejected in the first step whose color has the maximum L* value.

16. The method according to claim 15, wherein the first step ejects all the inks whose colors have the L* values greater than 40, and wherein the second step ejects all the inks whose colors have the L* values equal to or less than 40.

17. The method according to claim 16, wherein the first step ejects all the inks whose colors have the L* values equal to or greater than 60, and wherein the second step ejects all the inks whose colors have the L* values less than 60.

18. The method according to claim 16, wherein the first step ejects all the inks other than an ink whose color has a minimum L* value, and wherein the second step ejects only the ink whose color has the minimum L* values.

* * * * *